US009132397B2

(12) United States Patent
Anderberg

(10) Patent No.: US 9,132,397 B2
(45) Date of Patent: Sep. 15, 2015

(54) STIRRING APPARATUS AND METHOD

(71) Applicant: Huhnseal AB, Landskrona (SE)

(72) Inventor: Goran Anderberg, Landskrona (SE)

(73) Assignee: HUHNSEAL AB, Landskrona (SE)

( * ) Notice: Subject to any disclaimer, the term of this patent is extended or adjusted under 35 U.S.C. 154(b) by 0 days.

(21) Appl. No.: 13/867,532

(22) Filed: Apr. 22, 2013

(65) Prior Publication Data

US 2013/0229890 A1 Sep. 5, 2013

Related U.S. Application Data

(63) Continuation of application No. 12/553,176, filed on Sep. 3, 2009, now abandoned.

(51) Int. Cl.

| | |
|---|---|
| ***B01F 7/20*** | (2006.01) |
| ***B01F 7/00*** | (2006.01) |
| ***B01F 3/08*** | (2006.01) |
| ***B01F 3/12*** | (2006.01) |
| ***B01F 7/28*** | (2006.01) |
| ***B01F 15/00*** | (2006.01) |

(52) U.S. Cl.

CPC ..... *B01F 7/00016* (2013.01); *B01F 3/0853* (2013.01); *B01F 3/1221* (2013.01); *B01F 7/00158* (2013.01); *B01F 7/285* (2013.01); *B01F 15/00201* (2013.01); *B01F 15/00389* (2013.01)

(58) Field of Classification Search

CPC ..... B01F 7/20; B01F 7/0025

USPC ..... 366/325.1, 330.1; 416/91

See application file for complete search history.

(56) References Cited

U.S. PATENT DOCUMENTS

| | | | |
|---|---|---|---|
| 169,835 | A | 11/1875 | Payne |
| 3,526,467 | A | 9/1970 | Kime |
| 4,468,130 | A | 8/1984 | Weetman |
| 4,544,281 | A | 10/1985 | Wilkinson |
| 5,037,209 | A | 8/1991 | Wyss |
| 5,810,476 | A | 9/1998 | Muntener |
| 6,250,797 | B1 | 6/2001 | Weetman |
| 6,334,705 | B1 | 1/2002 | Weetman |
| 2002/0031048 | A1 | 3/2002 | Lipp |

FOREIGN PATENT DOCUMENTS

| | | |
|---|---|---|
| EP | 0542713 A1 | 4/1982 |
| JP | 57 059624 | 11/1992 |

*Primary Examiner* — David Sorkin

(74) *Attorney, Agent, or Firm* — Larson & Larson, P.A.; Frank Liebenow; Patrick Reid

(57) ABSTRACT

An apparatus for mixing a viscous flowable medium includes a receptacle for receiving the viscous flowable medium and has a substantially vertically arranged rotatable stirring axle and a stirring assembly that comprises at least one stirring element. In one embodiment, the stirring element is arranged at a lower end of the stirring axle substantially perpendicular thereto for rotation of the stirring element around the stirring axle. The stirring elements are shovel-like and are open towards an end of the stirring axle remote from the lower end and inclined with a slant angle in rotation direction towards a bottom of the receptacle, such that said viscous liquid upon rotation of the stirring axle is at least partly directed upwards in the receptacle by the at least one shovel-like stirring element.

20 Claims, 5 Drawing Sheets

STIRRING APPARATUS AND METHOD

PRIOR APPLICATIONS

This application is a continuation of U.S. patent application Ser. No. 12/553,176 filed on Mar. 9, 2009, which takes priority from International Application No. PCT/EP2008/052834, filed on Mar. 10, 2008, which in turn takes priority on Swedish application No. 0700603-4 filed Mar. 10, 2007.

FIELD OF THE INVENTION

This invention pertains in general to the field of apparatuses for stirring viscous media, e.g. for mixing purposes or for preventing sedimentation of a media. More particularly, the invention relates to such apparatuses having a stirring axle and perpendicular to the stirring axle arranged stirring elements.

BACKGROUND OF THE INVENTION

Various mixing apparatuses are known in the art. For instance, a mixing apparatus has been disclosed in EP 0542 713. The mixing of fluids takes place in a mainly cylindrical mixing vessel by means of a revolving mixing element disposed therein. Homogeneity of a settling fluid in the mixing vessel is maintained by keeping a flow direction in the vessel as vertical as possible. This is ensured by an agitator shaft having attached thereto a first mixing element in the form of paddles or blades by means of which the flow in the vessel is kept columnar at the central section, as well as a second mixing element, also in the form of paddles or blades, which deflects the axial flow via a radial flow into a rising annular flow.

However, the device of EP 0542 713 is not suited for mixing viscous fluids as the attack area of the blades provides a too large flow resistance for an effective use in viscous fluids.

U.S. Pat. No. 5,246,289 discloses an agitator assembly for use in effecting dispersion of a fluid such as a gas in a liquid comprises a rotor having a rotatably driven shaft mounting a series of scoop-shaped blades which are oriented with the mouths of the scoops presented in the direction of rotation of the shaft, each blade being mounted at an angle of attack such that one end of the blade leads the other in the direction of rotation. To eliminate gas cavity formation, each blade is of generally streamlined configuration in section and the ends thereof are generally parallel to the direction of motion of the blade.

However, the device of U.S. Pat. No. 5,246,289 is designed for facilitating dispersion of a fluid in a liquid and avoiding gas cavity formation. The device is not suited for mixing viscous fluids because high rotational resistance of the disclosed device makes it unsuited for mixing of viscous liquids.

In U.S. Pat. No. 5,037,209 an apparatus for the mixing of fluids, in particular pasty media and a process for its operation, is disclosed. A stirring mechanism, with a plurality of hollow, at least partially conically shaped stirring elements, which are provided with two openings, are symmetrically offset and are fixed on the stirring shaft at least approximately tangential to an imaginary circular cylinder coaxial to the stirring shaft.

However, the conically shaped stirring elements of the apparatus disclosed in U.S. Pat. No. 5,037,209 have a relatively large attack area, leading to a rotation of the fluid in the mixing receptacle around the stirring shaft. A rotation of the fluid implies a less effective mixing effect as the relative speed between the conically shaped stirring elements and the fluid decreases.

In the case of certain media having a high viscosity, or a high load of heavy particles, there is the risk that a plug forms within the conically shaped stirring elements of the apparatus disclosed in U.S. Pat. No. 5,037,209, so that medium can no longer flow through the mixing element.

Moreover, manufacturing of the conically shaped stirring elements of the apparatus disclosed in U.S. Pat. No. 5,037,209 is costly. A metal sheet has to be rolled to the desired conical shape and the junction is welded. Manual treatment is required to give the conical element a desired smooth surface, especially in the region of the welded junction, such that viscous medium does not attach to the stirring element during operation.

Furthermore, it is difficult to provide stirring of the lower bottom layer in the mixing container by means of the conically shaped stirring elements of the apparatus disclosed in U.S. Pat. No. 5,037,209. For instance, in downward oriented dome shaped bottoms of such containers, bottom sediment is built up, at least in the center of the dome, during mixing with the apparatus of U.S. Pat. No. 5,037,209.

In addition, the stirring mechanism is difficult to assemble in the mixing container, where only a small inspection door is provided for access to the interior of the mixing container. This is especially the case where the stirring mechanism is provided in a non-symmetrical form, such as with three or more arms.

In practice, various products are sequentially manufactured in one and the same mixing apparatus. Between different products the receptacle, in which the products are mixed, has to be cleaned thoroughly in order to prevent cross contaminations. The receptacle is basically a closed container in order to prevent contaminants from entering the container during mixing. Also, during operation, for safety reasons, stirring apparatuses are designed to close seal-tightly. Still, cleaning is desired to be made as fast and easy as possible. One established method is high pressure cleaning, wherein a hose, having a spray ball at its end introduced into the tank for cleaning, is entered into the receptacle through a small inspection door, that can be opened for this purpose, in the top of the receptacle. The conically shaped stirring elements of the apparatus disclosed in U.S. Pat. No. 5,037,209 are difficult to clean. High pressure cleaning does not reach parts of the cones. Hence, the receptacle has to be filled with a cleaning liquid to a level above the stirring mechanism. Then a time consuming stirring of the cleaning liquid is performed. Cleaning time is further extended by a counter flow that is created in the cleaning liquid around the conical stirring elements. The counter flow deteriorates for instance the cleaning effect of the cleaning liquid at the frontal edge of the conical stirring elements. Moreover, a considerable amount of cleaning liquid, in the range of several thousand liters, is used for each cleaning process. Compared with e.g. high pressure cleaning by means of a spray ball, this leads to increased operation costs and environmental drawbacks, especially when the same receptacle is used for different products and changes are frequent, e.g. several times a day.

In U.S. Pat. No. 6,250,797 an apparatus for the mixing of fluids, in particular gas-to-liquid or liquid-to-liquid dispersion and a process for its operation, is disclosed. A impeller mechanism, with a plurality of blades, which have slots extending essentially all the way between tip and hub ends thereof, are symmetrically offset and are fixed on the stirring shaft at least approximately tangential to an imaginary circular cylinder coaxial to the stirring shaft.

Moreover, the slots are to ensure passageways through the impeller blades and thereby reducing the tendency for bubbles to grow or coalesce into large bubbles disrupting the mass transfer to the liquid which is pumped with the impeller. Furthermore, to achieve an efficient mass transfer in the liquid the impeller blades are inclined with a large slant angel in rotation direction and there each blade surface is substantially large.

However, the large blade surface area together with the slant angel give rise to a large energy consumption for the impeller system disclosed in U.S. Pat. No. 6,250,797, when applying it to a flowable medium with high viscosity, as for instance gruel or pap, due to large shear forces as the impeller system rotates.

Furthermore, the slant angel, with which the blades are arranged makes cleaning potential difficult as part of the blades are not reachable using high pressure cleaning, although the slots may ease the cleaning process they substantially add hidden areas with potential growth of bacterial. Altogether, the mixing system disclosed in U.S. Pat. No. 6,250,797 is not suitable for mixing food or liquid to be served to human or animal.

Moreover, with a flowable medium with a high order of viscosity the medium tends to follow in the circumferential direction of the rotating blades instead of being mixed in a vertical direction induced by the blades slant angel. Thus, the stirring effect of the flowable medium is absent or at least substantially reduced. Also, stirring efficiency is very low due to this fact, i.e. the amount of energy needed for an effective stirring is high in relation to the stirring effect obtained. Most energy is used for rotating the viscous media without obtaining a stirring effect.

In US 2002/0031048 a vertical mixer is disclosed with an up-ward conveying mixing spiral achieved with several mixing blades arranged after each other in the circumferential direction. It is further disclosed that an additional mixing spiral can be arranged in axial direction after the first mixing spiral with a transition zone arranged in between. Although an effective mixing is achieved the total number of individual blades needed can have an undesired effect on the viscous flowable medium, especially if it contains for example soft particles, such as fruits or other brittle substances. Moreover, as the specification in US 2002/0031048 teaches of multiple sets of mixing spirals, each comprising several mixing blades, question can be raised whether sufficient cleaning can be achieved, crucial if the mixed food or liquid is to be served to human or animal. The proposed construction of the mixing spirals and arranged mixing blades implies possible hidden areas which could promote a growth of bacteria due to insufficient cleaning possible without complete disassembly of the apparatus for cleaning.

Hence, an improved mixing apparatus for viscous liquids would be advantageous and in particular a mixing apparatus for viscous liquids allowing for increased cost-effectiveness, and/or mixing efficiency and/or ease of cleaning would be advantageous.

SUMMARY OF THE INVENTION

Accordingly, embodiments of the present invention preferably seeks to mitigate, alleviate or eliminate one or more deficiencies, disadvantages or issues in the art, such as the above-identified, singly or in any combination by providing a stirring apparatus comprising a stirring element, a method of producing such a stirring element, a method of stirring a viscous medium with such an apparatus, and a computer program controlling stirring of a viscous medium in such an apparatus, according to the appended patent claims.

The stirring apparatus may advantageously be configured to keep heavy particles in suspension in a viscous flowable medium, and/or keep said heavy particles in said viscous flowable medium in motion, and/or substantially prevent sedimentation of said heavy particles in said viscous flowable medium, and/or mix at least two components of said viscous flowable medium; and/or blend at least two components of a viscous flowable medium, respectively, in a receptacle provided and configured for stirring the viscous flowable medium.

Some embodiments of the invention provide for effective mixing of a viscous medium in a cylindrical container.

Some embodiments of the invention also provide for cost effectively manufacturability of stirring elements.

Some embodiments of the invention provide for easy cleaning of stirring arrangements in a receptacle.

Some embodiments of the invention provide for gentle stirring of sensitive viscous products.

Some embodiments of the invention provide for stirring of viscous products without degassing the latter.

Some embodiments of the invention provide for stirring of viscous products without adversely affecting a consistency thereof.

Some embodiments provide for blending a powder into a liquid while avoiding formation of clumps.

Some embodiments provide for a tranquil movement for stirring a viscous medium while avoiding sedimentation thereof.

Some embodiments provide for a homogenous distribution of a viscous medium under stirring.

Some embodiments provide for a stirring of viscous media in large receptacles, such as tanks of up to 50 $m^3$ volume and up to 6 meters height, with a single stirring element.

Some embodiments provide for efficient stirring with a minimum of energy required.

It should be emphasized that the term "comprises/comprising" when used in this specification is taken to specify the presence of stated features, integers, steps or components but does not preclude the presence or addition of one or more other features, integers, steps, components or groups thereof.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DETAILED DESCRIPTION

Figure 1:
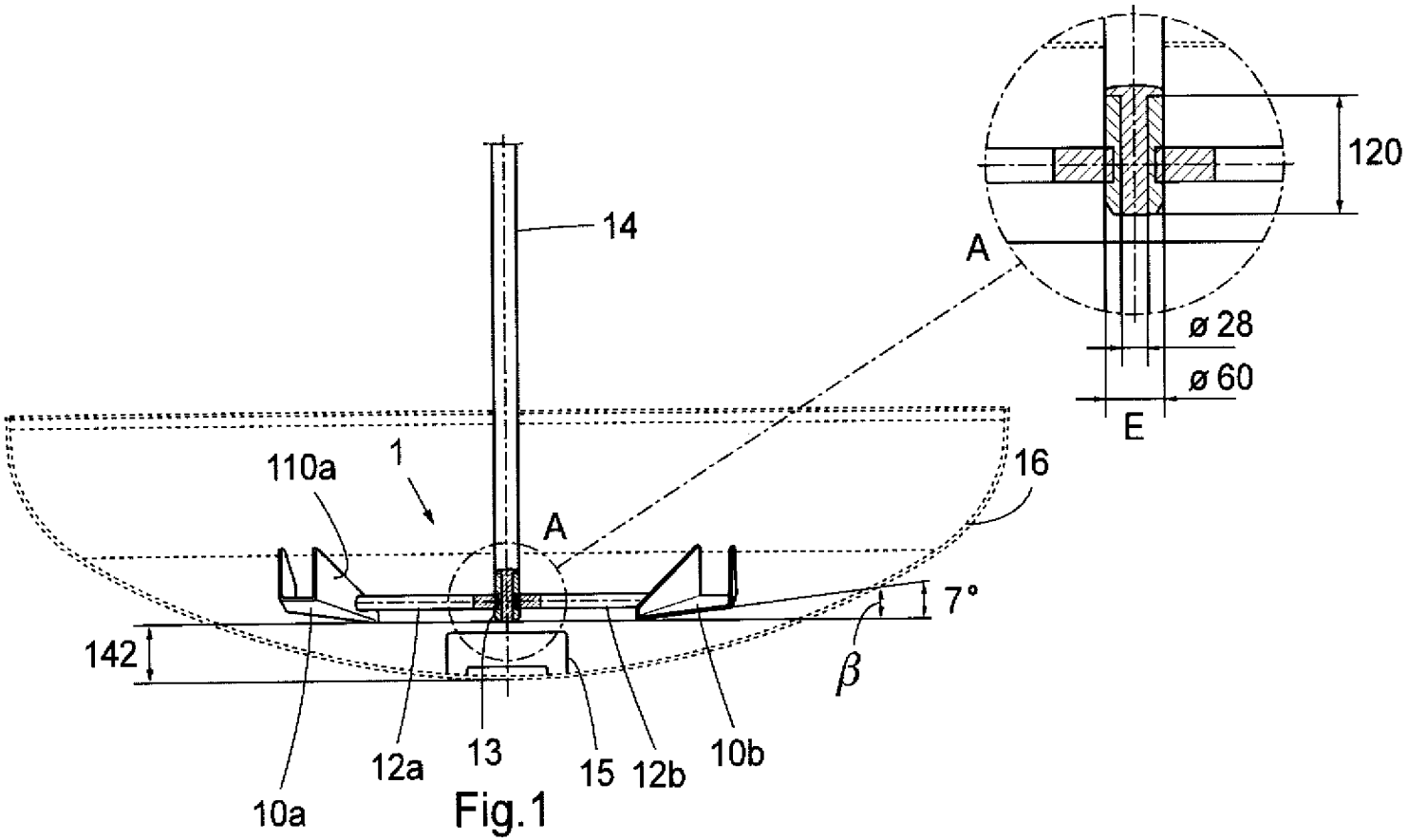
FIG. 1 is a schematic illustration of a stirring element, in a lateral perspective view, attached to a stirring axle and arranged in the bottom section of a mixing receptacle, in a sectional view.
Figure 2:
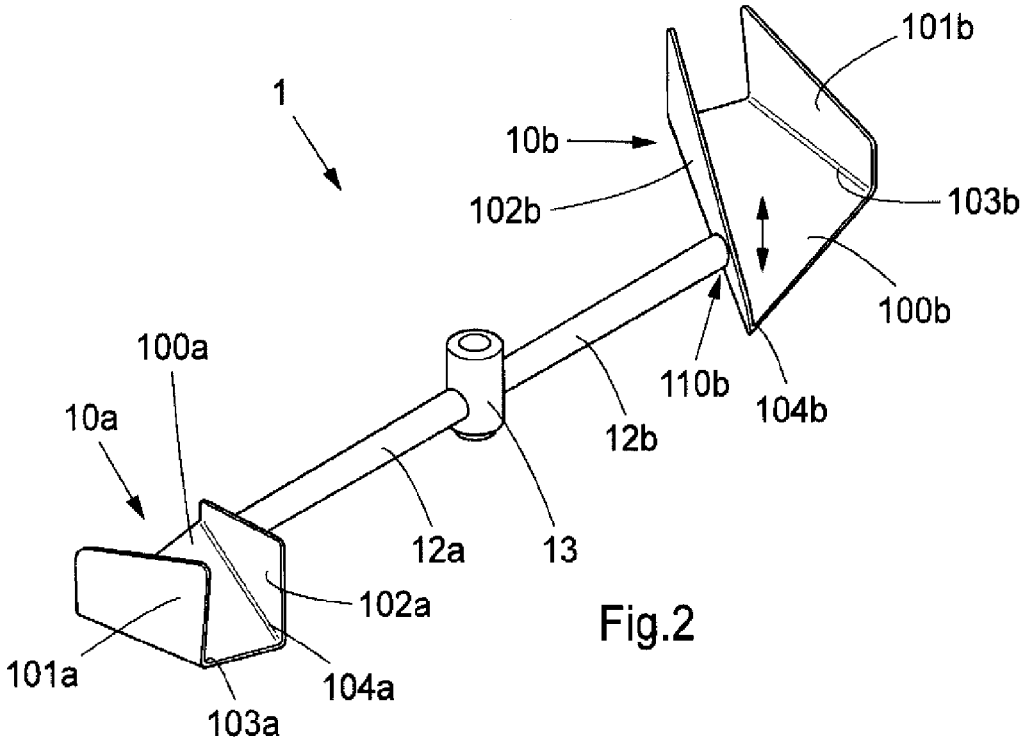
FIG. 2 is a perspective view showing schematic illustration of the stirring element of FIG. 1 in more detail.

Embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The following description focuses on an embodiment of the present invention applicable to a stirring apparatus for food industry. However, it will be appreciated that the invention is not limited to this application but may be applied to many other fields where viscous media are mixed, including for example production of paint, or biotechnological installations. Viscous flowable media that may be stirred embodiments of the invention are for instance gruel or pap (Viscosity e.g. 1000 CentiStokes (cSt)), chocolate pudding (Viscosity e.g. 4000 cSt), rice pudding (Viscosity e.g. 14000 cSt), fruit cream (Viscosity e.g. 15000 cSt), milk, juice, yoghurt, sour milk, etc.

Some embodiments of the invention provide for stirring of viscous products without degassing the latter. This may for instance be desired when stirring products such as fruit yoghurt, which is desired to have a fluffy consistency. Degassing the product would lead to an undesired change of the consistency.

In biotechnical applications for instance bacteria is often cultivated in a nutrient solution and gently stirred. Other applications comprise stirring applications during production of ethanol from an organic material, such as corn or sugar beets.

In an embodiment of the invention according to FIGS. 1 to 5, a stirring assembly 1 comprises two symmetrically arranged stirring elements in the form of stirring shovels. It is anticipated that, in other embodiments, more than two symmetrically arranged stirring elements are deployed, even though two are shown in the Figures. Each of the two stirring elements 10*a*, 10*b* is attached to a stirring axle 14 via a connecting rod 12*a*, 12*b*, respectively. Connecting rods 12*a*, 12*b* may also be called support arms or connecting arms. The support arms preferably have a low cross section in rotation direction in order not to lead to a rotational movement of the viscous medium in the receptacle 50. Connecting rods 12*a*, 12*b* are at one end thereof attached to stirring axle in end connector 13. Connecting rods or connecting arms 12*a*, 12*b* are at the other end thereof attached to stirring elements 10*a*, 10*b*, at a stirring element mounting position 110*a*, 110*b*, respectively. The connecting rods are arranged substantially perpendicular to the stirring axle 14, such that stirring elements 10*a*, 10*b* rotate on an imaginary circular line around stirring axle 14 upon rotation thereof.

In the preferred configuration, each of stirring elements 10*a*, 10*b* comprises a lower stirring element portion 100*a*, 100*b*, respectively. Each of the lower stirring element portions 100*a*, 100*b* is connected to an outer lateral stirring element portion 101*a*, 101*b*, via an outer junction 103*a*, 103*b*, respectively. Opposite to the outer lateral stirring element portions 101*a*, 101*b*, each of the lower stirring element portions 100*a*, 100*b* is connected to an inner lateral stirring element portion 102*a*, 102*b*, respectively, via an inner junction 104*a*, 104*b*, respectively.

In alternate embodiments, each of the stirring elements 10*a* and 10*b* are formed of different shapes providing similar functionality. For example, in another embodiment, the lower stirring element portions 100*a*/100*b* are curved and meet the outer lateral stirring element portion 101*a*/101*b* at a gradual curved outer junction 103*a*/103*b* and the lower stirring element portions 100*a*/100*b* meet the inner lateral stirring element portion 102*a*/102*b* at a gradual curved outer junction 104*a*/104*b*. In such, the overall cross-sectional shape of each of the stirring elements 10*a*/10*b* resembles a "V" with either a curve or angular vertex.

Figure 5:
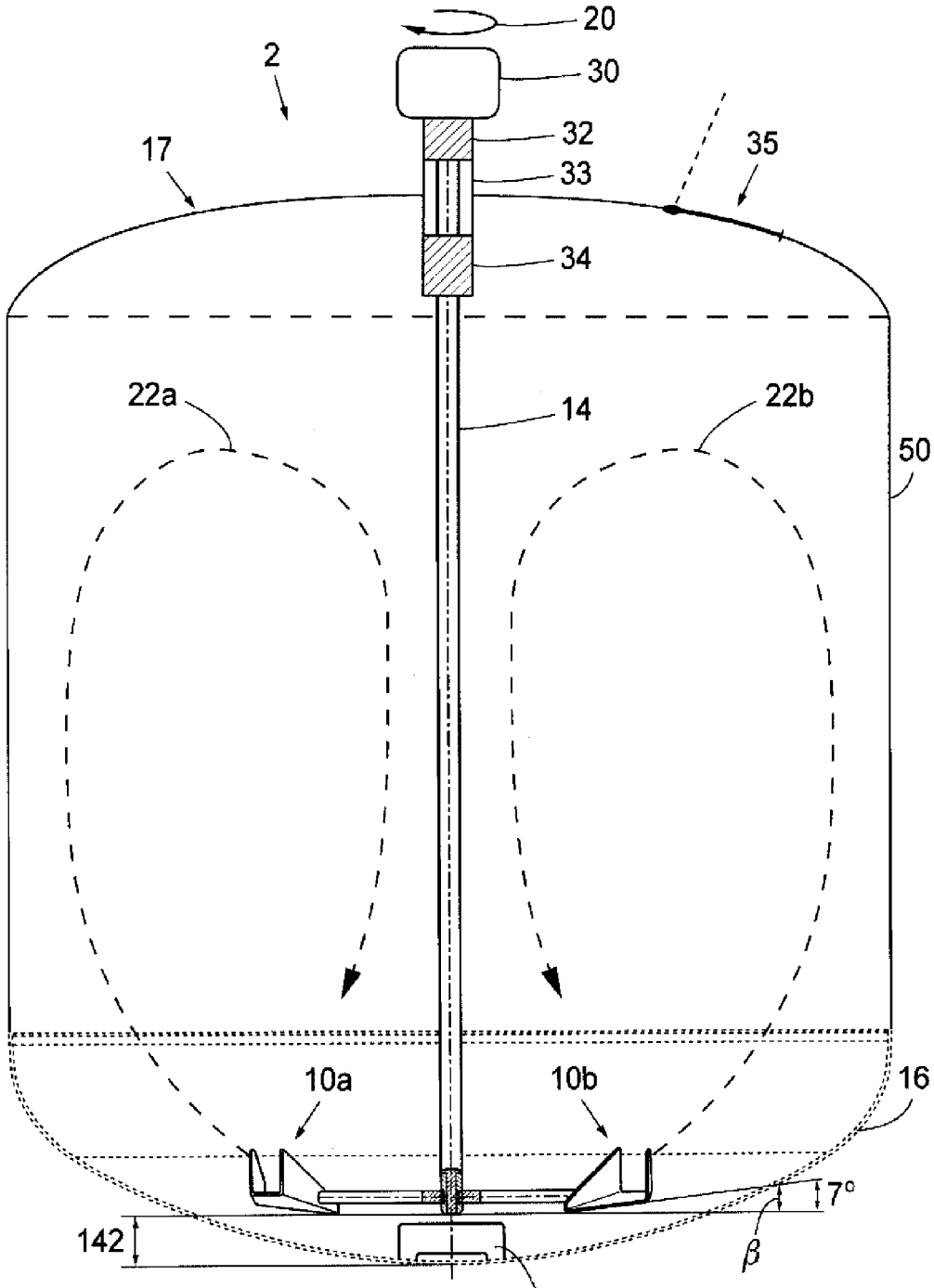
FIG. 5 is a schematic view illustrating a mixing apparatus comprising the stirring element of FIG. 1.
Figure 6:
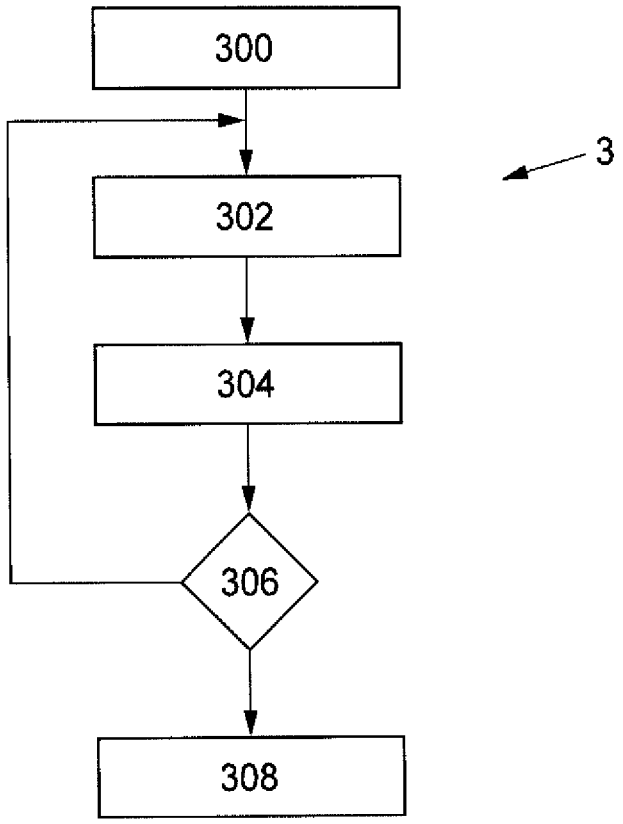
FIG. 6 is a flow chart illustrating a method of mixing a viscous medium.

An apparatus 2 for mixing a viscous flowable medium is depicted in FIG. 5. The apparatus may mix viscous flowable media, such as viscous liquids, such as yoghurt, orange juice, or high viscosity flowable media, such as cream or butter. The apparatus has a receptacle 50 for receiving said viscous flowable medium therein. The apparatus comprises further the substantially vertically arranged rotatable stirring axle 14 and the stirring assembly 1. Stirring assembly comprises at least one stirring element in said receptacle. By providing at least two stirring elements in a symmetrical arrangement, shear forces may be minimized. The stirring elements are arranged at a lower end 13 of the stirring axle 14, substantially perpendicular thereto, for rotation of the stirring elements around the stirring axle 14. More particularly, each of the stirring elements is a shovellike stirring element 10*a*, 10*b*, respectively, which is open towards upwardly, e.g. towards an end of said stirring axle 14 that is remote from the lower end 13, or towards an upper end of a receptacle 50. Each of the shovellike stirring elements 10*a*, 10*b* is inclined with a rotational slant angle in rotation direction towards a bottom 16 of the receptacle 50. The rotational slant angle of the two stirring elements is either the same, or different. In the case of the stirring elements being arranged with the same rotational slant angle, shear forces in rotational direction are minimized upon rotation, minimizing mechanical stress but also sway of stirring axle 14. As the shovellike stirring elements 10*a*, 10*b* are slanted in rotation direction, the viscous medium is upon rotation of the stirring axle 14 at least partly directed upwards in the receptacle 50 by the shovellike stirring elements 10*a*, 10*b*. The rotational slant angle may be chosen depending on a viscosity of a viscous flowable medium in the receptacle, or a desired mixing degree thereof, in case one or more components are provided as the viscous flowable medium for mixing.

Embodiments of apparatus 2 may comprise at least two of the stirring elements 10*a*, 10*b* arranged on the rotatable stirring axle 14 on substantially radially projecting support arms 12*a*, 12*b* at said lower end 13 of the stirring axle. Each of the shovellike stirring elements 10*a*, 10*b* has a substantially flat lower stirring element wall portion 100*a*, 100*b* that is inclined with said rotational slant angle relative to a plane of rotation substantially perpendicular to said stirring axle 14, and substantially flat lateral wall elements 101*a*, 101*b*, 102*a*, 102*b* approaching each other in a direction opposite rotation direction of said stirring axle 14. In this manner a channel inside the shovellike stirring elements 10*a*, 10*b* is created, which has a decreasing width, measured from inner to outer lateral wall. The lateral wall elements 101*a*, 101*b*, 102*a*, 102*b* are only connected to each other via the lower stirring element wall portion 100*a*, 100*b*, leaving an open space between the lower stirring element wall portion 100*a*, 100*b* such that the shovellike stirring elements 10*a*, 10*b* are open in one direction. The shovellike stirring elements 10*a*, 10*b* may be open towards an upper side 17 of the receptacle 50. Thanks to the open construction of shovellike stirring elements 10*a*, 10*b* cleaning thereof is facilitated as all surfaces are easily accessible.

In even more detail, the apparatus' lateral wall elements 101*a*, 101*b*, 102*a*, 102*b* comprise an outer lateral stirring element portion 101*a*, 101*b* connected to said lower stirring element wall portion 100*a*, 100*b* via an outer junction 103*a*,

103*b*, and an inner lateral stirring element portion 102*a*, 102*b* connected to the lower stirring element wall portion 100*a*, 100*b* via an inner junction 104*a*, 104*b*. The junction may be provided as an integral part, providing shovellike stirring elements 10*a*, 10*b* as monolithic elements. This may be provided by bending a suitably cut metal to the desired orientation as depicted in the Figs. In this case the lateral wall elements 101*a*, 101*b*, 102*a*, 102*b* and the lower stirring element wall portion are integrally made from a single sheet of metal. Inner junctions 104*a*, 104*b*, and outer junctions (103*a*, 103*b*) are provided as beveled bends. Media that is mixed in receptacle 50 will hardly fasten to the bends when these are provided with a suitably smooth finish, e.g. in polished stainless steel. Furthermore the bends are easy to clean. In other embodiments, the lower and lateral walls may also be welded to each other.

The support arms 12*a*, 12*b* are connecting to the inner lateral stirring element portion 102*a*, 102*b* at a wall surface thereof oriented towards the stirring axle 14. As depicted with the double headed arrow at shovellike stirring element 10*b* in FIG. 2, as well as depicted with the double headed arrows in FIG. 3, the attachment position is adjustable in all directions. In this way a lower edge of stirring assembly is adjustable to the geometry of the bottom 16 of receptacle 50. The distance of a lower end of said shovellike stirring elements 10*a*, 10*b* is adjustable with regard to said bottom 16 of the receptacle 50. For instance in the embodiment, e.g. shown in FIG. 5, the distance of the lower end of the stirring axle 14 to the lowest bottom level of a dome shaped bottom of receptacle 50 is about 14 cm. However, the distance of the lower end of the stirring elements to the adjacent receptacle wall is much less, e.g. 5 cm, due to the dome shape. This has proven to provide an advantageous mixing effect as sedimentation of particles contained in the liquid in receptacle 50 is effectively prevented from sedimenting at the receptacle bottom. One practical limitation of how close one of the outer edges of the stirring elements 10*a*, 10*b* may be arranged in relation to the outer edges is that the stirring axle 14 may sway radially to some extent due to the length of the stirring axle, which for instance extends over several meters, e.g. 4 meters, from the motor 30 into the receptacle. Sway may be minimized by positioning the motor under the bottom of the receptacle, which on the other hand necessitates a special sealing of the stirring axle coping with the load of the liquid in the receptacle.

Figure 3:
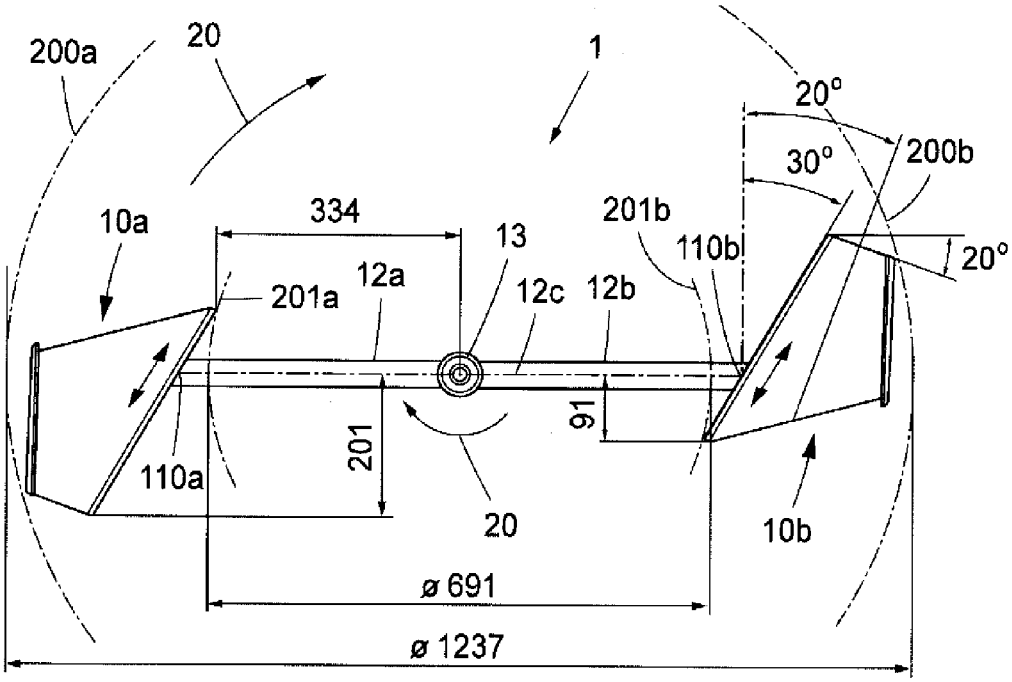
FIG. 3 is a view from above illustrating the stirring element of FIG. 1.
Figure 4:
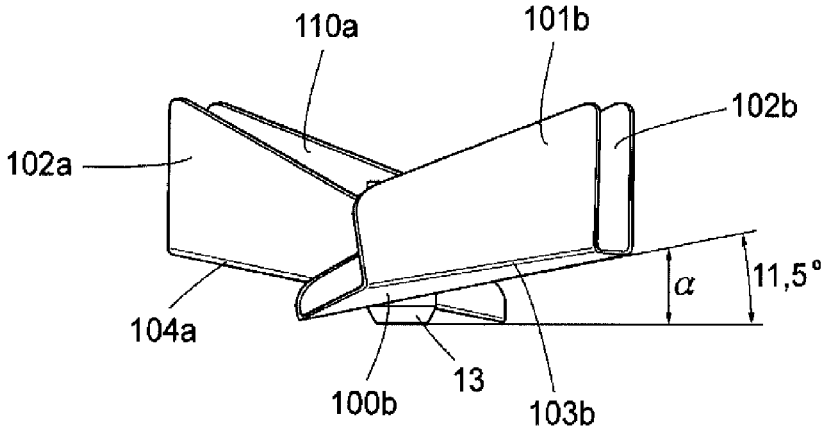
FIG. 4 is a lateral view of the stirring element of FIG. 1.

Also, the front edge of shovellike elements 10*a*, 10*b* may be inclined with regard to the support arms 12*a*, 12*b*. The inclination may be relative the longitudinal axle of the support arms 12*a*, 12*b*, as is illustrated in FIG. 3. This improves further efficiency of the shovellike stirring elements 10*a*, 10*b* in a container having a domed bottom 16. In an embodiment, the rear edge of shovellike stirring elements 10*a*, 10*b* is inclined in a direction opposite the front edge inclination, further improving distribution of the viscous medium in receptacle 50 for an effective mixing effect. Furthermore, the lower stirring element portion 100*a*, 100*b* may be inclined radially with a radial slant angle β relative the longitudinal axle 12*c* of the support arms 12*a*, 12*b*, as for instance is illustrated in FIGS. 1, 4 and 5, in a plane of rotation substantially perpendicular to said stirring axle 14. In the embodiment illustrated in the Figures, the radial slant angle β is 7°. However, the radial slant angle β may be between 1° and 30°, such as between 3° and 25°, 4° and 20°, 5° and 15°, or 6° and 10°, depending on parameters such as the viscosity of the liquid to be mixed, the geometry of the receptacle, the distance of the stirring elements from the stirring axle and the receptacle wall, or the size of the stirring elements in relation to the volume of the receptacle. This radial slant angle improves further efficiency of the shovellike stirring elements 10*a*, 10*b* in a container having a domed bottom 16, as for instance the stirring elements 10*a*, 10*b* may be arranged closer to the adjacent wall of receptacle 50.

Each of the shovellike stirring elements 10*a*, 10*b* is inclined with a radial slant angle β. The radial slant angle β of the two stirring elements is either the same, or different. In the case of the stirring elements being arranged with the same radial slant angle β, shear forces in rotational direction are minimized upon rotation, minimizing mechanical stress but also sway of stirring axle 14. As the shovellike stirring elements 10*a*, 10*b* are slanted in radial direction, the viscous medium is upon rotation of the stirring axle 14 at least partly directed inwardly in the receptacle 50, towards the stirring axle 14, by the shovellike stirring elements 10*a*, 10*b*. However, at least a part of the liquid thrusted by the shovellike stirring elements 10*a*, 10*b* may be directed towards the lateral, vertical wall of the receptacle 50, and further bouncing off therefrom, contribute to an advantageous stirring effect of the shovellike stirring elements 10*a*, 10*b*.

As is shown in the Figures, the substantially flat lower stirring element wall portion 100*a*, 100*b*, which is inclined with a rotational slant angle α and a radial slant angle β relative to a plane of rotation substantially perpendicular to said stirring axle 14, and the substantially flat lateral wall elements 101*a*, 101*b*, 102*a*, 102*b* are approaching each other in a direction opposite rotation direction of said stirring axle (14). This provides a Venturi effect inside the shovellike stirring elements 10*a*, 10*b* upon rotation. The viscous medium at the exit end of shovellike stirring elements 10*a*, 10*b* has thus a higher velocity than at the entry into the shovellike stirring elements 10*a*, 10*b*. Hence the medium is thrusted away from the shovellike stirring elements 10*a*, 10*b*, in a direction upward there from.

Furthermore, the substantially flat lateral wall elements 101*a*, 101*b*, 102*a*, 102*b* further increase wall height from the lower stirring element wall portion 100*a*, 100*b* in the direction opposite rotation direction of the stirring axle 14. In this manner an intake section of the shovellike stirring elements 10*a*, 10*b* increases in the direction opposite rotation direction of said stirring axle 14. The Venturi effect is thus further advantageously increased.

In an embodiment, a ratio of intake cross-section and exit cross-section of the shovellike stirring elements 10*a*, 10*b* is substantially constant along said shovellike stirring elements 10*a*, 10*b*. This embodiment has shown to have an advantageous mixing effect.

The rotational slant angle α of said shovellike stirring elements 10*a*, 10*b* may have a value that is chosen from a range that may be between 5 to 30 degrees, such as 5 to 20 degrees, 5 to 15 degrees, or 7 to 13 degrees. In an embodiment the rotational slant α angle is 11.5 degrees. The rotational slant angle is chosen depending on parameters such as the viscosity of the liquid to be mixed, the geometry of the receptacle, the distance of the stirring elements from the stirring axle and the receptacle wall, or the size of the stirring elements in relation to the volume of the receptacle.

A homogenous distribution of a viscous medium under stirring may be achieved with some embodiments of the shovellike stirring elements 10*a*, 10*b*.

In this manner, the surface of shovellike stirring elements 10*a*, 10*b* providing the stirring effect thereof is smaller than with known stirring elements. Hence stirring assembly is more effective, leading to a better and more effective stirring, although less power is consumed. In more detail, the effective attack surface of the shovellike stirring elements and the axle holding the shovel elements is rather low, for instance compared to the conical elements of the stirring element disclosed in U.S. Pat. No. 5,037,209. Thus the present stirring element is more effective, i.e. less drive power has to be used for rotating the stirring element in a viscous medium. Furthermore the stirring efficiency is improved, as measurements have shown. The stirring element of certain embodiments may thus be driven by a smaller motor as was necessary hitherto. This means that the driving unit including the motor may be dimensioned smaller and cheaper. Moreover the energy consumption for stirring a viscous medium may be reduced with certain embodiments. A rotation of the viscous medium to be mixed is also low. According to the method described below, rotation of the viscous medium may further be reduced.

FIG. 5 is a schematic view illustrating the mixing apparatus 2 comprising the stirring assembly 1 of FIGS. 1 to 4. This mixing apparatus 2 may be used for mixing viscous media or high viscosity media, and comprises a receptacle 50 for receiving the medium (not illustrated) in the interior thereof. The rotatable stirring axle 14 is vertically arranged in the receptacle 50. Support arms 12*a*, 12*b* extend substantially radially away from the lower end of stirring axle 14. The upper end of stirring axle 14 is connected to a driving unit 30, e.g. in the form of an electrical motor. A sealing unit and two bearings provide support for stirring axle 14. Other sealing and bearing constructions may be used, e.g. integrated into a single unit. In an embodiment, a domed receptacle top 17 of receptacle 50 is provided with an upper bearing 32 and a lower bearing 34. The domed top 17 also comprises an inspection door 35 through which access to the interior of receptacle 50 is provided.

Stirring elements 10*a*, 10*b* are provided at the forward end of support arms 12 *a*, 12*b*. The stirring elements 10*a*, 10*b* have shovel form with a lower wall surface and two lateral wall surfaces as described in more detail above. The lower wall surface and the two lateral wall surfaces are substantially straight shaped and provide a deviation of the viscous medium in receptacle 50 upon rotation of stirring axle 14. As the central axes of the stirring elements are inclined relative to the plane of rotation, and upward movement and circulation of the viscous medium in receptacle 50 is provided, as illustrated by means of arrows 22*a* and 22*b*. As can be seen in FIG. 3, the shovellike stirring elements 10*a*, 10*b* have an outer stirring element rotation circle 200*a*, 200*b* and an inner stirring element rotation circle 201*a*, 201*b* and a direction of rotation 20.

Circulation direction of the viscous medium in receptacle 50 is depicted with arrows 22*a*, 22*b*.

The inspection door 35 may for instance be used during assembly of the stirring axle 14 and the stirring assembly 1 in the receptacle 50. Also, cleaning may be provided through the inspection door 35, for instance by introducing an end of a high pressure hose, e.g. with a ball spray element, into the receptacle. In this case, cleaning of the entire interior of receptacle 50 is made without the need of filling the receptacle with a cleaning fluid. The ball spray element moves along inside the receptacle and provides a distribution of high pressure rays that reach both the top and side surfaces of stirring elements 10*a*, 10*b* as well as the lower surfaces thereof.

The stirring assembly 1 is arranged close to the bottom 16 of the receptacle 50, providing effective mixing even at the bottom 16. In an embodiment the receptacle 50 is a cylindrical container and the bottom 16 is a downwardly domed bottom thereof. An embodiment of the cylindrical container comprises a vortex element 15 at the bottom 16 below said lower end 13 in order to direct a flow of the viscous medium in that region and to avoid whirl built-up.

In embodiments the stirring axle may be arranged off-center in the receptacle receiving the viscous media to be mixed. This embodiment provides even further improved mixing.

In the illustrated embodiment, the stirring shaft 14 is vertically arranged. However, it is also conceivable to position the shaft 14 at a slant, i.e. deviating from the vertical direction, or from a direction parallel to a longitudinal axle of a mixing receptacle.

Figure 7:
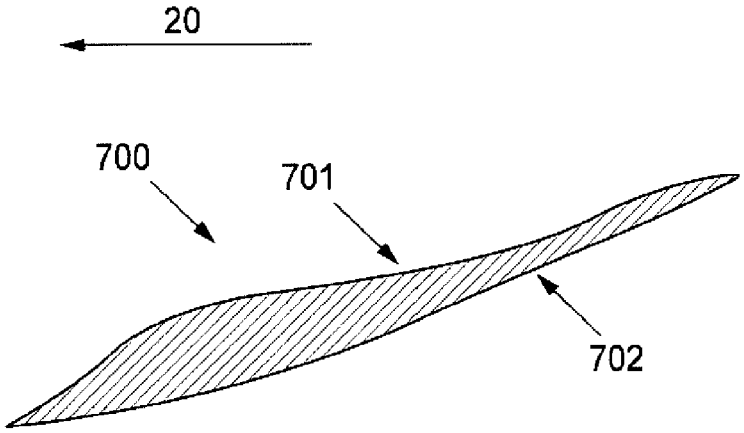
FIG. 7 is a cross sectional view of the profile of an embodiment of a lower stirring element portion of a stirring element.

A further embodiment of a stirring element comprises a stirring element having an alternative shape of the lower stirring element portion of a stirring element. FIG. 7 is a cross sectional view of the profile of this embodiment. The remaining elements, such as lateral walls of the stirring element are not further illustrated, as are described in detail above. As can be seen in FIG. 7, the cross sectional profile of the lower stirring element portion 700 is not flat, but has a wing like shape. This leads to a velocity difference of the fluid flow past the upper side 701 and lower side 702 of the lower stirring element portion 700. This results in a further thrust given to the stirred viscous medium in the stirring receptacle relative to the stirring element, when passing this during rotation of the stirring axle. A stirring element comprising the lower stirring element portion 700 may be produced by a casting process.

According to embodiments a plurality of stirring assemblies is arranged on the stirring axle 14. In addition to the stirring assembly 1 at a lower end of the stirring axle 14, further stirring assemblies may be arranged at a distance from the lower end 13 on the stirring axle 14. The stirring assemblies may have the connection arms arranged offset in rotational direction from each other, e.g. 90 degrees when two stirring assemblies, each having two connection arms opposite each other, are arranged on the stirring axle 14, or e.g. 60 degrees when three such stirring assemblies are arranged on the stirring axle 14. In this manner a stirring effect may further be enhanced and e.g. sedimentation of heavy particles in the viscous medium to be stirred effectively prevented. These embodiments provide for the same advantageous cleanablity, e.g. with a spray ball.

A method of producing a shovellike stirring element 10*a*, 10*b* comprised in the above described apparatus comprises bending a suitably cut metal plate at two bending locations to form the shovellike stirring element 10*a*, 10*b*, and attaching the shovellike stirring element 10*a*, 10*b* to the stirring axle 14, for instance by support arms 12*a*, 12*b*. A suitable metal is for instance stainless steel, e.g. in a grade and/or surface finish suitable for food processing.

Alternatively, a shovellike stirring element may be produced by casting or molding processes. The stirring element and connecting arm may be cast or molded together, integrally as a monolithic element. Furthermore, several stirring elements and connecting arms may be cast or mold together, forming an integral monolithic part. This is cost effectively. Also, a single material may be used for the monolithic part, reducing production cost. In addition or alternatively, a suitable polymer material may be used for the monolithic part, minimizing production cost. The material may be fiber reinforced for improved mechanical strength.

A method of stirring a viscous medium in a receptacle by using an apparatus 2 comprises intermittently rotating said shovellike stirring elements 10*a*, 10*b* at different circumferential velocities in a range from 0 to 30 meters/second (m/s) in order to limit a rotational movement of said viscous flowable medium in said receptacle 50 around said stirring axle 14. A circumferential velocity of 0 m/s means that the stirring axle 14 does not rotate. However, the liquid in the receptacle 50 still may have a relative rotational velocity in relation to the stirring elements 10*a*, 10*b*. as long as the rotational velocity of the liquid exceeds the circumferential velocity of the stirring elements 10*a*, 10*b*, this leads to a decelerating effect, slowing down the rotational movement of the liquid in the receptacle 50.

When mixing, circumferential velocities of the stirring elements 10*a*, 10*b* may be set in a range from 1.5 to 30 m/s. In an embodiment this corresponds to a range from 10 to 600 revolutions per minute of the stirring axle 14, such as 10, 25, 50, 100, 250, 400, 500 or 600 revolutions per minute of the stirring axle 14.

More precisely, a rotation of the viscous medium around stirring axle 14 is not desired, as in this case mixing efficiency decreases. The rotation of the viscous medium in receptacle 50 may be monitored by suitable sensors, such as optical sensors, e.g. Doppler based sensors, mechanical sensors, or differential pressure sensors. Monitoring may be performed through a window suitably arranged in inspection door 35. In an embodiment without sensors, power consumption of a motor driving the stirring axle 14 is monitored. Power consumption is at a maximum level when starting to mix the viscous medium. When rotation of stirring assembly is established, power consumption decreases to a defined level that is below the maximum level. With time, the viscous medium will start to rotate in the receptacle 50 along with stirring assembly 1. Power consumption will decrease, which is a measure that rotational speed of both the medium and the stirring assembly is approaching each other. In an embodiment of the method, circumferential velocity of the stirring assembly 1 is regulated based on this power consumption input signal. This may be implemented without the use of additional sensors of the type described above.

For instance the circumferential velocity is decreased in order to slow down the rotation of the viscous medium in receptacle 50. The stirring assembly may also be stopped completely during intermittent periods in order to limit the rotation of the viscous medium in the receptacle 50.

The rotational direction of stirring axle 14 may be reversed in order to achieve a faster slowing down effect of a rotational velocity of the viscous liquid in the stirring receptacle. The stirring elements of the above describe embodiments contribute to an advantageous effect of such a temporary reversed rotational direction, as a gentle slowing down effect is achieved. For instance foaming is advantageously avoided by the stirring elements.

Thus, an effective method of making mixing more effective is provided according to some embodiments.

A computer program may be provided to control the stirring of the viscous liquid in the receptacle. The computer program may comprise a code segment for execution in a computer, for intermittently rotating the shovellike stirring elements 10*a*, 10*b* at different circumferential velocities in a range from 0 to 30 meters/second in order to limit the rotational movement of the viscous flowable medium in the receptacle 50 around the stirring axle 14.

The computer program may be stored on a computer-readable medium, enabling carrying out of the above described advantageous method.

EXAMPLE

A stirring apparatus according to the attached Figures was used for stirring a viscous medium.

The requirements specifically demanded of the apparatus were the following in particular:

The mixing mechanism should be able to mix a creamy substance, such as soured milk or yoghurt, with fruit particles.

Test Data:

Tank diameter: 3000 mm

Tank height: 4000 mm

Tank content: 20 $m^3$ (20 000 liters)

Medium: fruit cream

Viscosity: 15000 CentiStokes (cSt)

Density: 1

Temperature: 10 DEG C.

Dimensions of stirring elements: according to the attached Figures and related description above.

Drive motor: 2.2 kW

Stirring speed: 200 rpm, respectively.

Result: An excellent mixing effect was achieved after a mixing time of 20 minutes with low power requirement and operating costs.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will be appreciated by one of skill in the art, the present invention may be embodied as device, system, method or computer program product. Accordingly, the present invention may take the form of an entirely hardware embodiment, a software embodiment or an embodiment combining software and hardware aspects all generally referred to herein as a "circuit" or "module." Furthermore, the present invention may take the form of a computer program product on a computer-usable storage medium having computer-usable program code embodied in the medium. Any suitable computer readable medium may be utilized including hard disks, CD-ROMs, optical storage devices, a transmission media such as those supporting the Internet or an intranet, or magnetic storage devices.

The following are the original claims as filed in the original PCT application:

A. An apparatus (2) configured for stirring a viscous flowable medium, such as a viscous liquid, said apparatus comprising a receptacle (50) for receiving said viscous flowable medium therein, said apparatus having a substantially vertically arranged rotatable stirring axle (14) and a stirring assembly (1) comprising at least one stirring element in said receptacle (50), wherein said at least one stirring element is arranged at said stirring axle (14), substantially perpendicular thereto, for rotation of said stirring element around said stirring axle (14), wherein said at least one stirring element is a shovellike stirring element (10*a*, 10*b*), which is inclined with a rotational slant angle (α) in rotation direction towards a bottom (16) of said receptacle (50), and open in a direction pointing from said bottom (16), such that said viscous liquid upon rotation of said stirring axle (14) is at least partly directed upwards in said receptacle by said at least one shovellike stirring element (10*a*, 10*b*) whereby said apparatus is configured to keep heavy particles in suspension in said viscous flowable medium, and/or keep said heavy particles in said viscous flowable medium in motion, and/or substantially prevent sedimentation of said heavy particles in said viscous flowable medium, and/or mix at least two components of said viscous flowable medium; and/or blend at least two components of said viscous flowable medium;

respectively, in said receptacle (50) for said stirring.

B. Apparatus according to claim A, comprising at least two of said stirring elements (10*a*, 10*b*) arranged on said rotatable stirring axle (14) on substantially radially projecting support arms (12*a*, 12*b*), wherein each of the shovellike stirring elements (10*a*, 10*b*) has a lower stirring element wall portion (100*a*, 100*b*, 700) that is inclined with said slant angle relative to a plane of rotation substantially perpendicular to said stirring axle (14), and substantially flat lateral wall elements (101*a*, 101*b*, 102*a*, 102*b*) approaching each other in a direction opposite rotation direction of said stirring axle (14), wherein the lateral wall elements (101*a*, 101*b*, 102*a*, 102*b*) are only connected to each other via said lower stirring element wall portion (100*a*, 100*b*), leaving an open space between said lower stirring element wall portion (100*a*, 100*b*) such that said shovellike stirring elements (10*a*, 10*b*) are open towards an upper side (17) of said receptacle (2).

C. The apparatus according to claim A, wherein each of said lateral wall elements (101*a*, 101*b*, 102*a*, 102*b*) comprises an outer lateral stirring element portion (101*a*, 101*b*) connected to said lower stirring element wall portion (100*a*, 100*b*) via an outer junction (103*a*, 103*b*), and an inner lateral stirring element portion (102*a*, 102*b*) connected to said lower stirring element wall portion (100*a*, 100*b*) via an inner junction (104*a*, 104*b*).

D. The apparatus according to claim C, wherein said lateral wall elements (101*a*, 101*b*, 102*a*, 102*b*) and said lower stirring element wall portion are integrally formed from a single sheet of metal, whereby said inner junction (104*a*, 104*b*) and said outer junction (103*a*, 103*b*) are beveled bends.

E. The apparatus according to claim D or D, wherein one of said support arms is connecting to said inner lateral stirring element portion (102*a*, 102*b*) at a wall surface thereof oriented towards said stirring axle (14).

F. The apparatus according to any of claims B to E, wherein said lower stirring element wall portion (100*a*, 100*b*) that is inclined with said rotational slant angle relative to a plane of rotation substantially perpendicular to said stirring axle (14), and said substantially flat lateral wall elements (101*a*, 101*b*, 102*a*, 102*b*) that are approaching each other in a direction opposite rotation direction of said stirring axle (14), whereby a Venturi effect is provided in said shovellike stirring elements (10*a*, 10*b*) upon rotation thereof.

G. The apparatus according to any of claims B to F, comprising a symmetrical arrangement of two of said shovellike stirring elements (10*a*, 10*b*) in said stirring assembly (1).

H. The apparatus according to any of claims B to G, wherein one of said support arms (12*a*) and one of said the shovellike stirring elements (10*a*) form a monolithic part.

I. The apparatus according to any of claims B to H, wherein said substantially flat lateral wall elements (101*a*, 101*b*, 102*a*, 102*b*) further increase wall height from said lower stirring element wall portion (100*a*, 100*b*) in said direction opposite rotation direction of said stirring axle (14), such that an intake section of said shovellike stirring elements (10*a*, 10*b*) increases in said direction opposite rotation direction of said stirring axle (14).

J. The apparatus according to claim I, wherein a ratio of intake cross-section and exit cross-section of the shovellike stirring elements (10*a*, 10*b*) is substantially constant along said shovellike stirring elements (10*a*, 10*b*).

K. Apparatus according to any of claims B to J, wherein said lower stirring element wall portion (100*a*, 100*b*) is substantially flat.

L. Apparatus according to any of claims B to J, wherein said lower stirring element wall portion (700) has a cross sectional profile that is wing like.

M. The apparatus according to any of the preceding claims, wherein the rotational slant angle (α) of said shovellike stirring elements (10*a*, 10*b*) is 5 to 30 degrees, such as 11.5 degrees, depending on a viscosity of said viscous flowable medium, or a desired mixing degree thereof.

N. The apparatus according to any of the preceding claims, wherein said stirring assembly (1) is arranged close to said bottom (16) of said receptacle (50).

O. The apparatus according to claim N, wherein said receptacle (50) is a cylindrical container and said bottom (16) is a downwardly domed bottom thereof.

P. The apparatus according to claim O, wherein said cylindrical container comprises a vortex element (15) at said bottom (16) below said stirring axle (14).

Q. The apparatus according to any of the preceding claims, wherein a distance of a lower end of said shovellike stirring elements (10*a*, 10*b*) is adjustable with regard to said bottom (16) of said receptacle (50).

R. The apparatus according to any of the preceding claims, wherein said shovellike stirring element (10*a*, 10*b*) is further inclined with a radial slant angle (R).

S. The apparatus according to claim R, wherein the rotational slant angle (α) of said shovellike stirring elements (10*a*, 10*b*) is between 1 degree and 30 degrees, such as between 3 degrees and 25 degrees, 4 degrees and 20 degrees, 5 degrees and 15 degrees, or 6 degrees and 10 degrees, such as 7 degrees.

T. The apparatus according to any of the preceding claims, wherein said direction pointing from said bottom (16) is oriented from a lower end (13) of said stirring axle (14) to an end of said stirring axle (14) arranged remote from said lower end.

U. The apparatus according to any of the preceding claims, wherein said projecting support arms (12*a*, 12*b*) are arranged at a lower end (13) of said stirring axle (14).

V. The apparatus according to claim U, wherein at least one further stirring assembly is arranged on said stirring axle at a distance from said lower end (13).

W. A method of producing a shovellike stirring element (10*a*, 10*b*) comprised in the apparatus according to any of claims A to V, said method comprising bending a suitably cut metal plate at two bending locations to form said shovellike stirring element (10*a*, 10*b*), and attaching said shovellike stirring element (10*a*, 10*b*) to said stirring axle.

X. A method of stirring a viscous medium in a receptacle by using an apparatus (2) according to any of claims A to V, said method comprising intermittently rotating said shovellike stirring elements (10*a*, 10*b*) at different circumferential velocities in a range from 0 to 30 meters/second in order to limit a rotational movement of said viscous flowable medium in said receptacle (50) around said stirring axle (14).

Y. The method according to claim X, wherein a power consumption of a motor driving said stirring axle (14) is monitored providing a control signal for said circumferential velocity.

Z. The method according to claim X or Y, wherein said circumferential velocity is 1.5 to 30 m/s.

AA. The method according to claim Z, wherein said circumferential velocity is 1.5 to 30 m/s corresponds to a range from 10 to 600 revolutions per minute of the stirring axle (14), such as 10, 25, 50, 100, 250, 400, 500 or 600 revolutions per minute of the stirring axle (14).

BB. A computer program for stirring a viscous liquid in a receptacle by using an apparatus (2) according to any of claims A to V, said computer program for processing by a computer, the computer program comprising a code segment for intermittently rotating said shovellike stirring elements (10*a*, 10*b*) at different circumferential velocities in a range from 0 to 30 meters/second in order to limit a rotational movement of said viscous flowable medium in said receptacle (50) around said stirring axle (14).

CC. The computer program of claim BB stored on a computer-readable medium, enabling carrying out of a method according to claims W to AA.

DD. A stirring element as comprised in the apparatus according to any of claims A to V.

Embodiments of the present invention are described herein with reference to flowchart and/or block diagrams. It will be understood that some or all of the illustrated blocks may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The present invention has been described above with reference to specific embodiments. However, other embodiments than the above described are equally possible within the scope of the invention. Different method steps than those described above, performing the method by hardware or software, may be provided within the scope of the invention. The different features and steps of the invention may be combined in other combinations than those described. The scope of the invention is only limited by the appended patent claims.

The invention claimed is:

1. An apparatus for stirring a viscous flowable medium, said apparatus comprising:

a receptacle for receiving said viscous flowable medium therein;

a vertically arranged rotatable stirring axle; and a stirring assembly comprising at least one stirring element within said receptacle;

wherein:

said at least one stirring element is connected to said stirring axle by a support rod that projects radially and substantially perpendicularly from the stirring axle;

said at least one stirring element comprises a lower wall, an outer lateral wall, and an inner lateral wall;

said lower wall and inner and outer lateral walls form a channel that is open in an upward direction from the bottom of said receptacle;

said lower wall of said at least one stirring element is inclined with a rotational slant angle in a direction of rotation such that rotation of said stirring axle causes said viscous flowable medium moving through said stirring element to be directed upward; and said at least one stirring element is arranged at an end of said rod at a distance from said stirring axle.

2. The apparatus according to claim 1, comprising a plurality of said stirring elements arranged on said rotatable stirring axle on radially projecting support rods wherein:

said inner and outer lateral walls are flat and are arranged with respect to said bottom wall to form a channel that narrows in a direction opposite the direction of rotation of said stirring axle.

3. The apparatus according to claim 2, wherein each of said inner and outer lateral walls comprises an outer lateral stirring element portion connected to said lower stirring element wall via an outer junction, and an inner lateral stirring element portion connected to said lower stirring element wall via an inner junction.

4. The apparatus according to claim 3, wherein said lateral walls and said lower stirring element wall are integrally formed from a single sheet of metal, whereby said inner junction and said outer junction are beveled bends.

5. The apparatus according to claim 2, wherein each of said support rods is connected to a surface of said inner lateral wall oriented towards said stirring axle.

6. The apparatus according to claim 2, comprising a symmetrical arrangement of two of said stirring elements in said stirring assembly.

7. The apparatus according to claim 1, wherein said support rod and said at least one stirring element form a monolithic part.

8. The apparatus according to claim 1, wherein a wall height of each of said flat lateral walls increases in a direction opposite said rotation direction of said stirring axle, such that an intake section of said at least one stirring element increases in said direction opposite said rotation direction of said stirring axle.

9. The apparatus according to claim 8, wherein a cross-sectional area of said channel of the at least one stirring element is constant along said stirring element.

10. The apparatus according to claim 2, wherein said lower stirring element wall is flat or has a cross sectional profile that is wing shaped.

11. The apparatus according to claim 1, wherein the rotational slant angle of said at least one stirring element is 5 to 30 degrees, and the rotational slant angle selected based upon a viscosity or a desired degree of mixing of said viscous flowable medium.

12. The apparatus according to claim 1, wherein said stirring assembly is arranged in proximity to a downwardly domed bottom of said receptacle, and wherein said receptacle is a cylindrical container.

13. The apparatus according to claim 1, wherein a distance between a bottom of the receptacle and a lower end of said at least one stirring element is adjustable.

14. The apparatus according to claim 12, wherein said cylindrical container comprises a vortex element at said bottom below said stirring axle.

15. The apparatus according to claim 1, wherein said at least one stirring element is further inclined with a radial slant angle.

16. The apparatus according to claim 15, wherein the radial slant angle is between 1 degree and 30 degrees.

17. The apparatus according to claim 1, wherein said support rod is arranged at a lower end of said stirring axle.

18. The apparatus according to claim 2, wherein at least one further stirring assembly is arranged on said stirring axle at a distance from said lower end.

19. The apparatus according to claim 2, wherein said stirring assembly and said plurality of stirring elements are arranged such that rotation of the stirring axle causes a circulation of the viscous flowable medium in the receptacle that is generally upward along lateral surfaces of the receptacle and generally downward near a central vertical axis of the receptacle.

20. The apparatus of claim 2, wherein each of said plurality of stirring elements is connected to said support rod at an attachment position on said inner lateral wall that is adjustable in all directions.

* * * * *